US009486115B2

(12) United States Patent
Carlson et al.

(10) Patent No.: US 9,486,115 B2
(45) Date of Patent: Nov. 8, 2016

(54) PRODUCT AND DISPENSING EQUIPMENT HOUSING

(71) Applicant: Ecolab USA Inc., St. Paul, MN (US)

(72) Inventors: Brian Philip Carlson, Lakeville, MN (US); Ryan A. Chernik, St. Paul, MN (US); Brian Michael Clemens, Burnsville, MN (US); Bradley Keith Lohrding, Edina, MN (US); Dana Marie Vajen Habig, Minneapolis, MN (US)

(73) Assignee: ECOLAB USA INC., St. Paul, MN (US)

( * ) Notice: Subject to any disclaimer, the term of this patent is extended or adjusted under 35 U.S.C. 154(b) by 0 days.

(21) Appl. No.: 13/796,845

(22) Filed: Mar. 12, 2013

(65) Prior Publication Data

US 2014/0263459 A1 Sep. 18, 2014

(51) Int. Cl.
*B67D 7/06* (2010.01)
*A47K 5/12* (2006.01)

(52) U.S. Cl.
CPC ..... *A47K 5/12* (2013.01); *B67D 2210/00031* (2013.01)

(58) Field of Classification Search
CPC ..... A47K 5/12; B67D 2210/00031
USPC ..... 222/156, 183, 182, 181.1, 181.2, 181.3; 220/4.01, 4.12, 4.13, 4.21, 4.24, 4.25, 220/669, 675; D06/542, 545
See application file for complete search history.

(56) References Cited

U.S. PATENT DOCUMENTS

| | | | | | |
|---|---|---|---|---|---|
| 3,078,016 | A * | 2/1963 | Judy | A47K 5/122 | 220/23.4 |
| 4,513,885 | A * | 4/1985 | Hogan | B67D 7/0205 | 222/105 |
| 4,634,022 | A * | 1/1987 | O'Halloran | A47K 5/1208 | 222/181.2 |
| 5,265,772 | A * | 11/1993 | Bartasevich | A47K 5/1209 | 222/153.01 |
| 5,431,304 | A * | 7/1995 | Gentile | A47K 5/122 | 222/103 |
| 5,464,125 | A * | 11/1995 | Daansen | A47K 5/1215 | 222/156 |
| 6,707,873 | B2 * | 3/2004 | Thompson | A47K 5/1208 | 377/13 |
| 7,066,357 | B2 * | 6/2006 | Ciavarella | A47K 5/1207 | 222/156 |
| D584,551 | S * | 1/2009 | Carlson | D6/545 | |
| 7,611,033 | B2 * | 11/2009 | Ganzeboom | A47K 5/14 | 222/105 |
| D634,142 | S * | 3/2011 | Meyerhoffer | D6/545 | |
| D662,743 | S * | 7/2012 | Meyerhoffer | D6/545 | |
| 2004/0232168 | A1 * | 11/2004 | Ciavarella | A47K 5/1207 | 222/156 |

OTHER PUBLICATIONS

"Roundtangle" Merriam-Webster.com. Merriam-Webster, Jul. 23, 2014.*
"Pillow" Merriam-Webster.com. Merriam-Webster, Jul. 24, 2014.*

* cited by examiner

*Primary Examiner* — J. Casimer Jacyna
*Assistant Examiner* — Benjamin R Shaw
(74) *Attorney, Agent, or Firm* — McKee Voorhees and Sease, PLC

(57) ABSTRACT

A primary outer housing component for equipment is disclosed. The housing may be configured to include two or more opposing continuous curvature forms, a form outlined generally defined by a series of arcs, a forward facing primary surface having a compound curve, and a secondary surface having a compound curve. The primary surface may be configured to have at least one roundtangle feature and one or more primary touch points.

25 Claims, 15 Drawing Sheets

PRODUCT AND DISPENSING EQUIPMENT HOUSING

BACKGROUND OF THE INVENTION

1. Field of the Invention

This invention relates generally to housing for equipment, and more particularly to housing for a product, packaging, device, apparatus, and equipment configured for dispensing, housing, protecting, supporting, or any of the like.

2. Description of Prior Art

Housing, such as the outer body of equipment, is commonly used to provide structural support for the equipment within the housing as well as a physical appearance to the observer. A housing may be changed, for example, and shaped, proportioned, textured, colored, or otherwise configured to accommodate the components or structure around which the housing is built. The housing may have a shape and proportion that mimics or is built around or to support the components or structure within. A housing for a product and dispensing equipment, for example, is generally configured in the same manner.

The present invention addresses these problems and provides a housing providing, amongst other things, structural support for components and equipment housed within while also providing consistency as to its shape, proportions, colors, texture, user interfaces, and branding to convey a common and uniform appearance and function.

SUMMARY OF THE INVENTION

Generally the invention relates to a robust set of design parameters that can be applied to various types and styles of equipment to aid in the cohesive visual presence as well as functionally increasing the usability by creating a common user interaction scheme.

In one embodiment, the invention is a dispenser. The dispenser includes one or more operational components, at least one comprising an operated dispense mechanism. A processor may be configured in communication with at least one of the operational components. A user interface may also be configured in communication with the processor. A primary outer housing generally encloses the one or more operational components. The primary outer housing may be configured to have a pair of opposing continuous curvature forms, a form outlined generally defined by a series of arcs, a forward facing primary surface having a compound curve, a secondary surface having a compound curve, optionally at least one roundtangle feature on primary surface, and one or more primary touch points on the primary surface.

In another embodiment, the invention is a primary outer housing component for equipment. The housing may be configured to include two or more opposing continuous curvature forms, a form outlined generally defined by a series of arcs, a forward facing primary surface having a compound curve, and a secondary surface having a compound curve. The primary surface may be configured to have at least one roundtangle feature and one or more primary touch points. Optionally, the primary surface may be absent of a roundtangle feature.

In another embodiment, the invention is product housing. The product housing includes a primary outer body adapted to at least partially enclose a product container. The primary outer body may be configured to include two or more opposing continuous curvature forms, a form outlined generally defined by a series of arcs, and forward facing primary surface having a compound curve, a secondary surface having a compound curve, at least one roundtangle feature, and one or more primary touch points.

BRIEF DESCRIPTION OF THE DRAWINGS

While the Specification concludes with claims particularly pointing out and distinctly claiming the invention, it is believed that the present invention will be better understood from the following description taken in conjunction with the accompanying drawings, in which:

DETAIL DESCRIPTION OF THE PREFERRED EMBODIMENTS

Referring to the figures, there is generally disclosed housing configuration concepts for product, dispensing and other equipment or apparatuses according to exemplary aspects of the present invention. The outer housing, body or shell may be configured, at least partially, around or to enclose a product, actuator, operational component, dispensing mechanism, dry or liquid product, etc. Each of these may require that the housing take on a different shape or proportion to accommodate the various size differences for each. Notwithstanding, a uniformity of shape, proportion, color, texture, user touch points, and other features may be maintained despite these differences. For example, a strategy may be imposed to maintain uniformity between the various configurations for a product or dispensing equipment housing. What follows are exemplary considerations of the present invention provided to illustrate various aspects that drive uniformity within a housing, shell or outer body of equipment, an apparatus, a product or dispensing equipment of the present invention. Table 1 below provides description for specific characteristics relating to product, apparatus or dispensing equipment housing of the present invention.

TABLE 1

Product Specifications

| | CLEAN | CURRENT | FOCUSED | ENGAGING | FLUID |
|---|---|---|---|---|---|
| VISUAL | White, mid-tone gray or dark gray should be the primary color with strategic use of darker grey in higher traffic areas. | Contemporary yet classic minimalistic design. Quality materials and finishes. | Organized composition and form. Utilize white, mid-tone gray or dark gray space to emphasize and highlight design elements. | Simple and compelling design draws attention. | Smooth yet defined. Flexible yet structured. Design effortlessly leads the eye around the product. |
| FUNCTIONAL | Smooth surfaces and textures avoid dust and dirt collection and allow for easy cleaning. Designed for easy maintenance so field associates can quickly replace parts that are damaged or degraded. | Interaction points leverage deep domain knowledge to create optimized ease of use features. Details such as latches are robust, easy to grip and use, yet integrated and easy to wipe clean. | Support ease of use through an intuitive layout of interaction points. Close the feedback loop by visually and physically matching alerts to required actions. | Interaction points and areas of focus are highlighted with color and formed to draw attention to their function. | Fluid surfaces have minimum nooks and crannies created by sharp surface transitions where dirt and grime might collect making the product easier to clean. |

Figure 1:
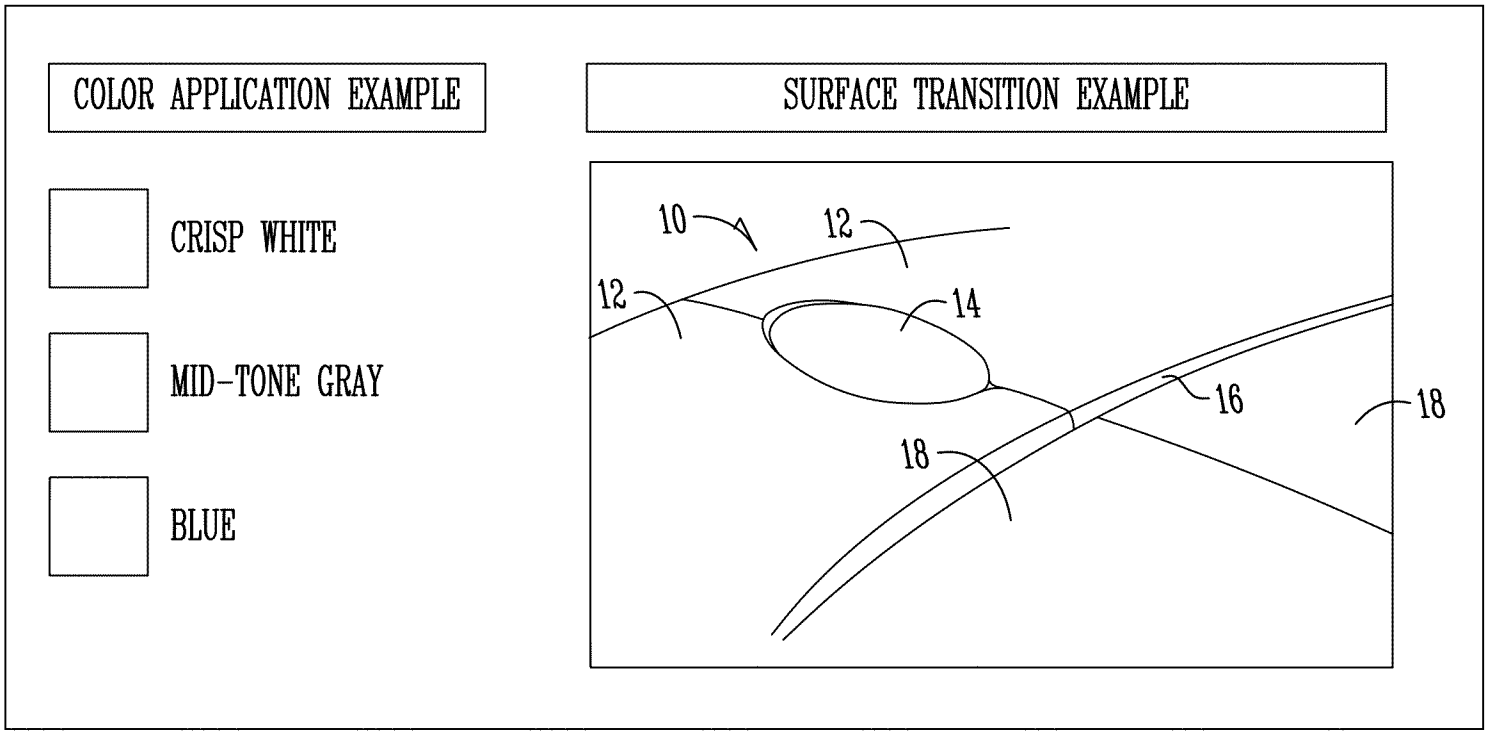
FIG. 1 is a pictorial representation of a surface rendering provide clean transitions from part to part to minimize the area for dirt to build up, and aide in cleaning the equipment and another representation of one color transition example for product and dispensing equipment housing illustrated according an exemplary aspect of the invention.

FIG. 1 provides an example of a section of product, an apparatus or dispensing equipment housing incorporating the principles of uniformity and function outlined, for example, above in Table 1. The pictorial representation provided in FIG. 1 illustrates a section of housing 10 for an exemplary product, apparatus or dispensing equipment housing of the present invention. A portion of the housing 10 illustrated in FIG. 1 is provided for purposes of illustrating both the visual and functional elements described in Table 1 above. The descriptions provided in Table 1 are for exemplary purposes only and do not limit the invention. This includes non-limiting references to specific color schemes using, for example, white as a color for a primary surface or a defined surface texture for the primary surface or other surfaces. Other colors are also contemplated, such as a solid color that successfully reduces the visual appearance of dirt, grease, fingerprints. For example, an interaction point 14 such as a latch, handle or button may be highlighted by the surrounding surface or white space 12 to emphasize and highlight or even alert the user as to the function or operation of the interaction point 14. The term "white space" is used in its generically descriptive sense and is not necessarily referring to the color of the space, as other colors like a mid-tone gray or dark gray could also serve as colors for white space 12. Other areas of the housing 10 may be configured as a high traffic area 18. Surface transition(s) 16 may be provided between any one or more of the described elements of the housing 10. The surfaces and surface transition 16 are generally smooth and have minimal nooks and crannies as well as being void of all sharp transitions where dirt or grime might otherwise collect. According to one exemplary aspect of the invention, housing 10 may be configured with an interaction point 14 which is blue in color to alert the user or draw the users attention to the feature or function of the interaction point 14. Surrounding surfaces such as white space 12 may be configured white in color to highlight and draw attention to the interaction point 14. A mid-tone gray or dark gray may also be used for other high traffic areas 18 so as to minimize the appearance of a dirty or grimy surface. The intent being, a high traffic area 18 often collects dirt and grime which is evident upon visual inspection. The intent, for example, is to have a darker color or a mid-tone grey for the high traffic area 18 to hide any dirt or grim that would collect over time and thereby discolor or give the wrong appearance. The present invention contemplates other color schemes in addition to those described. One overarching guideline can include for example, presenting surface colors to draw attention to, convey functionality or elicit a certain desired response from the user or observer. This can be accomplished with various other color schemes as not contemplated.

Figure 2B:
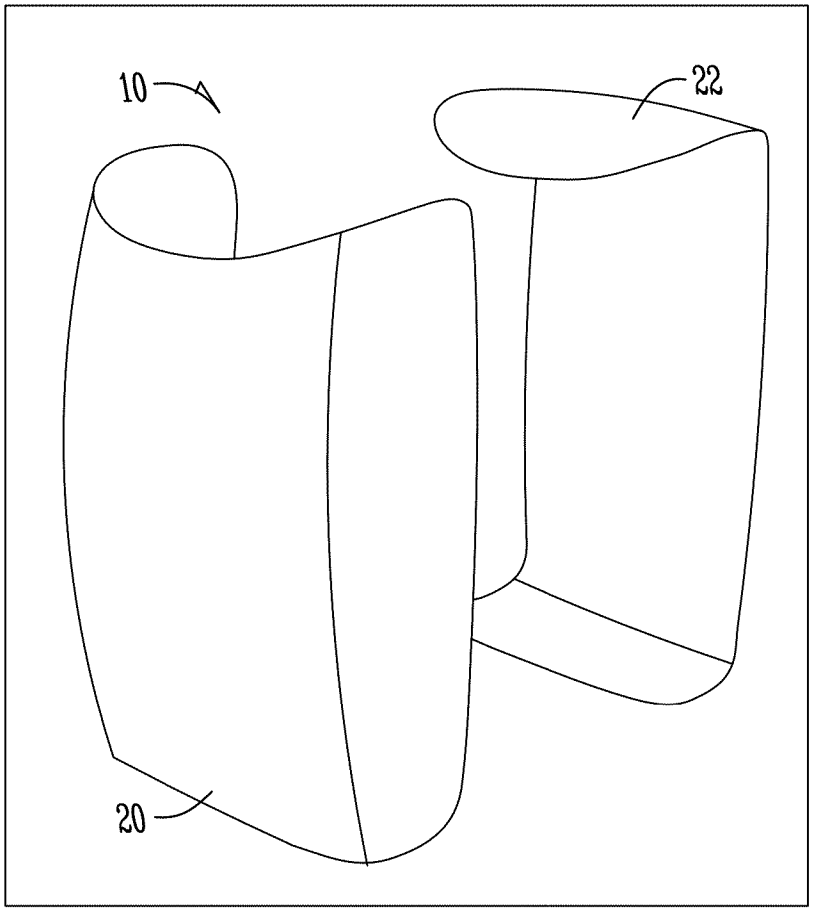
FIGS. 2A-2B are pictorial representations of horizontal and vertical wave construction forms for product and dispensing equipment housing illustrated according to an exemplary aspect of the invention.
Figure 2A:
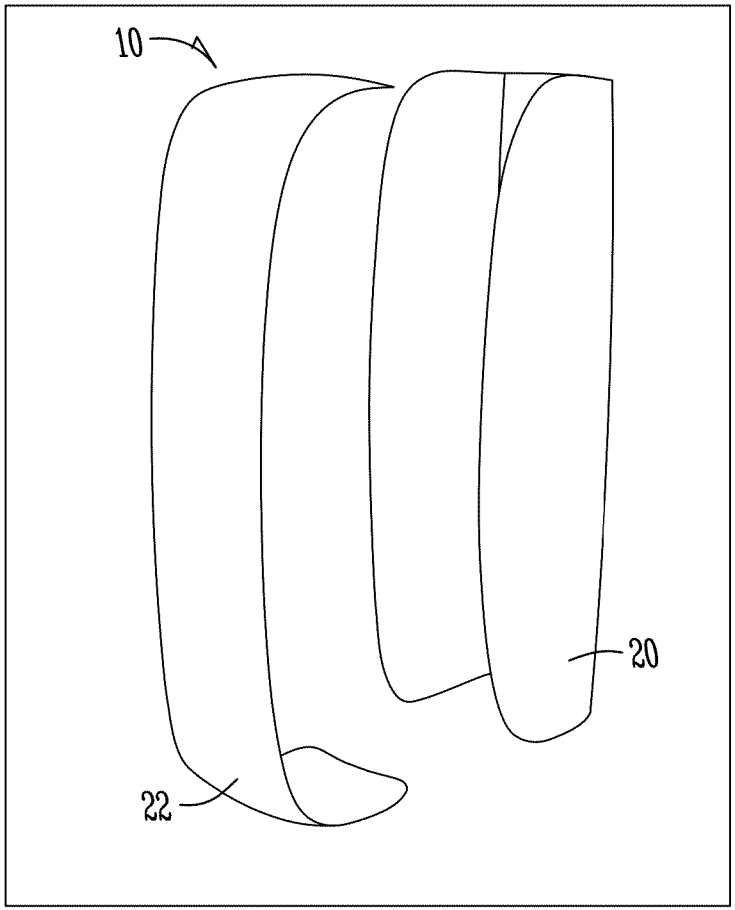

The portion of the housing 10 illustrated in FIG. 1 may be configured to be part of a body or housing, such as those illustrated in FIG. 2A-2B. Each housing, illustrated in FIGS. 2A-2B, is provided to illustrate a wave construction concept for the housing 10. Each housing 10 includes a curvature form 20 and curvature form 22 which taken together form two opposing curvature continuous forms. This type of form construction, may for example, be referred to as "baseball" construction type curvature form, which provides a "cresting wave" appearance. The cresting wave feature is a criterion of the invention that may, for example, be used to govern how two forms come together (see, e.g., curvature form 22). FIG. 2B illustrates housing 10 being configured with two opposing curvature continuous forms, namely curvature form 20 and curvature form 22. The curvature forms 20, 22 in FIG. 2B are configured or oriented in a horizontal manner, referred to as a horizontal construction where the wave form or curvature form 20 flows from left to right across the front and curvature form 22 flows from top to bottom across the back. FIG. 2A illustrates an example of vertical construction where curvature form 22 flows from top to bottom around the front and curvature form 20 flows left to right across the back. An example of both types of construction, namely horizontal construction of the curvature forms and vertical construction of the curvature forms is illustrated by the pictorial representation provided in FIG. 14. Note that the housing 10 illustrated in the top of the figure is a vertical type construction whereas the housing 10 in the bottom of the figure is a horizontal type construction. Thus, FIGS. 2A-2B provide pictorial representations for constructing two opposing curvature continuous forms, namely curvature form 20 and curvature form 22 to form a housing 10 as a shell or outer body of equipment, an apparatus, a product or a like construct of the present invention.

Figure 3:
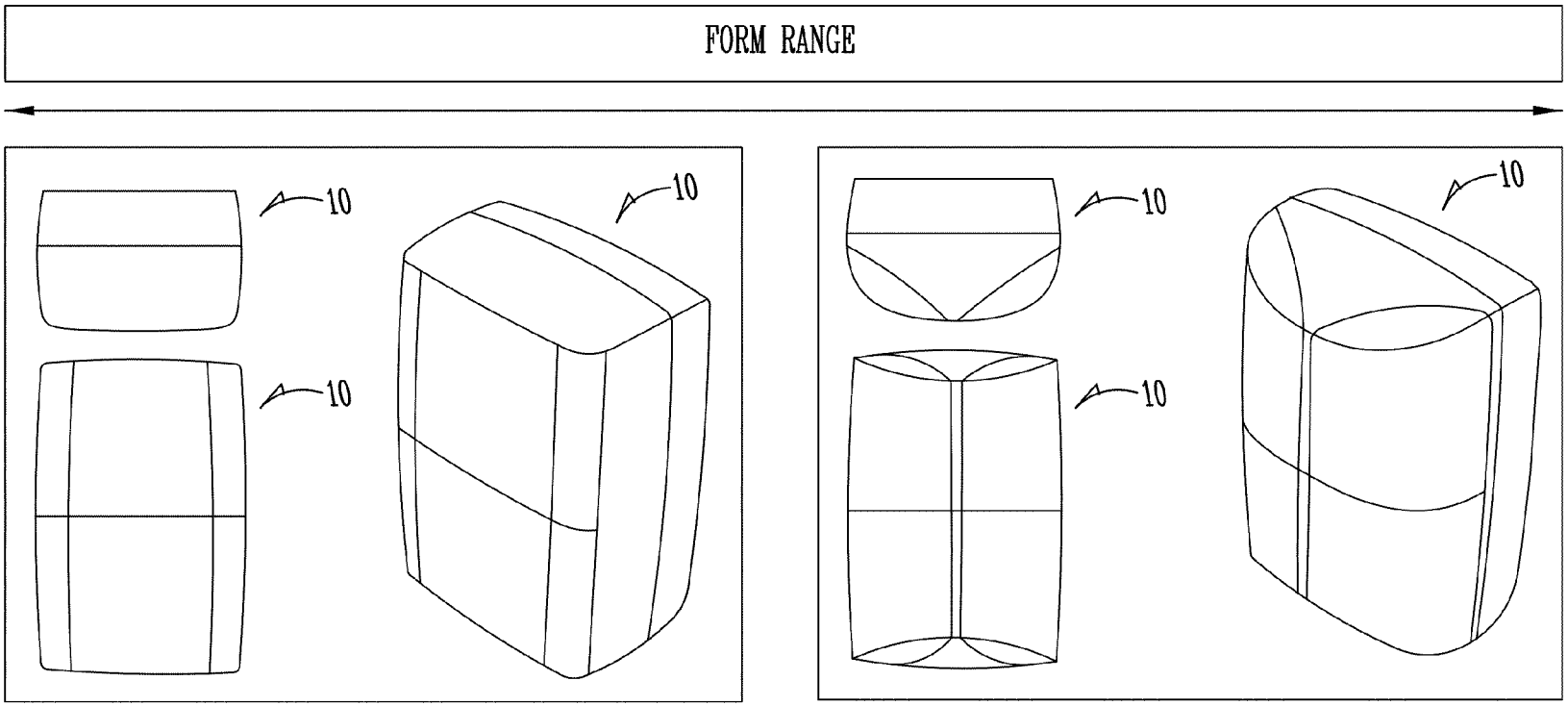
FIG. 3 is a pictorial representation of an exemplary outline for product and dispensing equipment housing providing a form range illustrated according to an aspect of the invention.

FIG. 3 provides pictorial representation of housing 10 in both left and right representations which are illustrative of the form range that housing 10 may take on while still maintaining a consistent and uniform appearance and while yet still capable of providing the functional features and aspects relating to the housing, shell or outer body of equipment, apparatus, product or like construct of the present invention. Both pictorial representations in FIG. 3 are constructed or configured as a horizontal wave construction as discussed in above relating to FIGS. 2A-2B. The image on the left provides one extreme or outer range for the form of housing 10 while the images on the right provide an opposite extreme or boundary for the form of the housing 10. The form of housing 10 within the form range provides a spectrum illustrating the uniformity of various configuration types of housing 10 that fall within a desirable form range of the present invention. This range may specified to give a certain flexibility to form. A softer form may be used to create a more user friendly configuration, or a sharper form to efficiently populate internal components or functional aspects for various configurations. The pictorial representation provided on the left hand side in FIG. 3 of an exemplary form range for housing 10 illustrates a perspective, front elevation and top plane view. Whereas, the pictorial representation on the right hand side illustrates by way of a perspective view, front elevation view and plan view another representation of the form for housing 10. Note that the emphasis on the white space 12, interaction point 14, surface transition 16, and high traffic area 18 illustrated in FIG. 1 changes through the form range for the housing illustrated in FIG. 3. Specifically, as surface transition(s) between various surfaces are further chamfered, rounded or softened the curvature form for housing 10 changes from that which is illustrated in the left hand view to that which is illustrated in the right hand view. Changing the form of housing 10 can provide emphasis to, draw attention of the user or elicit a desire interaction from the user.

Figure 4:
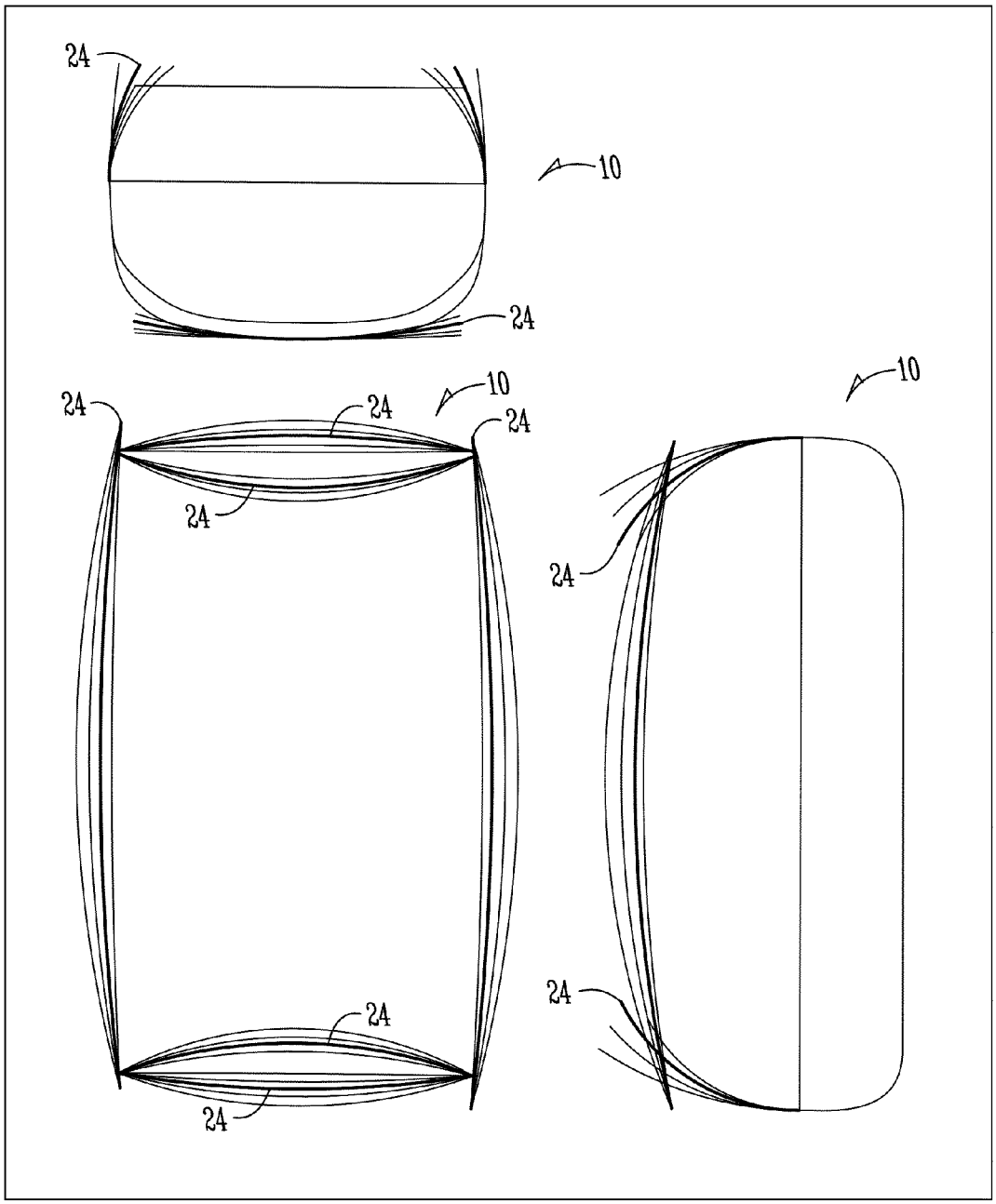
FIG. 4 is a pictorial representation providing a curvature range for product or dispensing equipment housing of the present invention.

FIG. 4 illustrates various configurations for outlines of the housing 10. Specifically, FIG. 4 includes a front elevation view, a side elevation view and a top plan view of an exemplary housing 10 of the present invention. A primary curve 24 shown in bold lines defines a proposed outline of housing in each of the views. In other aspects of the present invention, arcs are used as the primary curve 24 to define the outline of housing 10. The present invention also contemplates that splines can be used for the primary curve 24, for example, to troubleshoot or to resolve surface discrepancies, ambiguities or inconsistencies. The purpose of the pictorial representation provided in FIG. 4 is to illustrate the flexibility of the housing 10 by changing the primary curve parameters using exemplary arcs for illustrating a change in the outline of the housing 10. Each image in FIG. 4 depicts which curve (e.g., primary curve 24) is adjustable in developing the overall size and proportion of housing 10 so as to fit over, or at least partially enclose or cover, components within or of the housing 10. The primary curve lines 24 depict, for example, a recommended amount of curvature for defining the outline of housing 10. However, the curvature of primary curve 24 can be increased or decreased, such as illustrated in FIG. 3, to accommodate a desired size, shape, proportion, appearance as well as the operational components within or associated with the housing 10.

Figure 5:
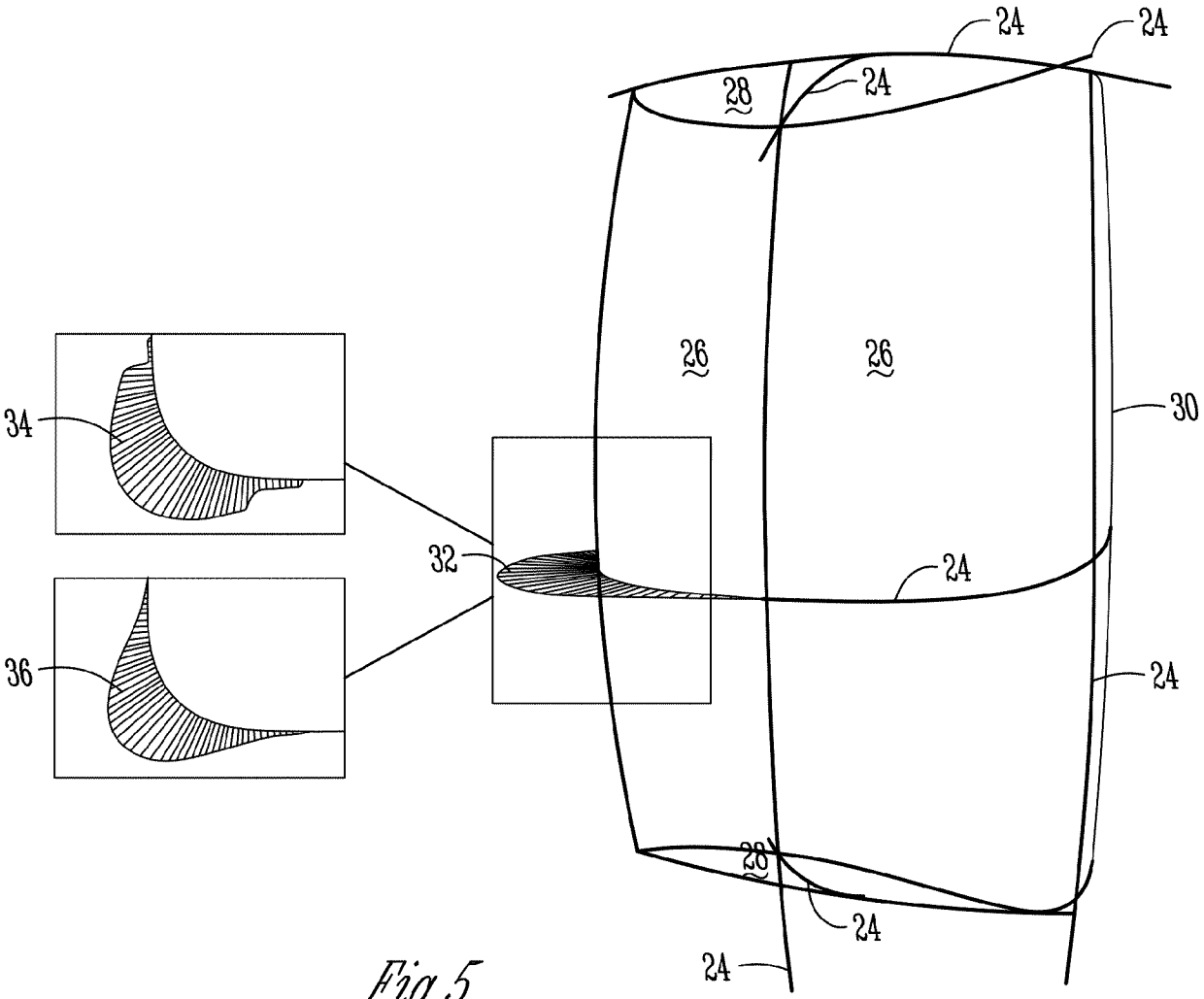
FIG. 5 is a pictorial representation providing exemplary surface curvature for product and dispensing equipment housing illustrated according to various aspects of the invention.

FIG. 5 is a pictorial representation of a housing 10 according to an exemplary aspect of the present invention. The housing 10 shown in FIG. 5 illustrates various contemplated surface curvatures for one or more of the surfaces of the housing 10. The housing 10 includes a primary surface 26. The primary surface 26 is preferably a forward facing primary or dominant surface of housing 10. According to a preferred aspect of the present invention, the primary surface 26 is created with G2 compound curved surfaces. Additionally, the housing 10 includes secondary surfaces 28 adjacent primary surfaces 26 which, preferably, are created also with G2 compound curved surfaces. However, the present invention contemplates that G1 tangent surfaces can also be used for the secondary surfaces 28. Generally, a back surface of housing 10 is configured to be flat so that the housing 10 may be positioned against a flat surface, such as would be the case when housing 10 is mounted on a wall. FIG. 5 provides a pictorial illustration within the window on the left side of the housing 10 illustrating a curvature comb 32 for the primary surface 26. The curvature comb 32 may be created, for example, using a G1 curvature comb 34 as illustrated in the top left pictorial representation or created by a G2 curvature comb 36 illustrated in the bottom left pictorial representation. Thus, the curvature comb 32 of primary surface 26 may be changed between the curvature comb designs illustrated. There are many methods known in the art for creating G2 curvature continuous surfaces and G1 curvature continuous surfaces. Curvature continuous, as opposed to purely tangent, is but one solid modeling technique to create surfaces with no visible points at which the curvature changes. The continuous curvature of the primary surface 26 is fashioned to form a housing 10 around, for example, operation equipment, internal components, hardware or software components and the like and to maintain a consistent and uniform appearance, which support a desired function and elicited response from the user interacting with the housing and the aforementioned components or the like.

Figure 6:
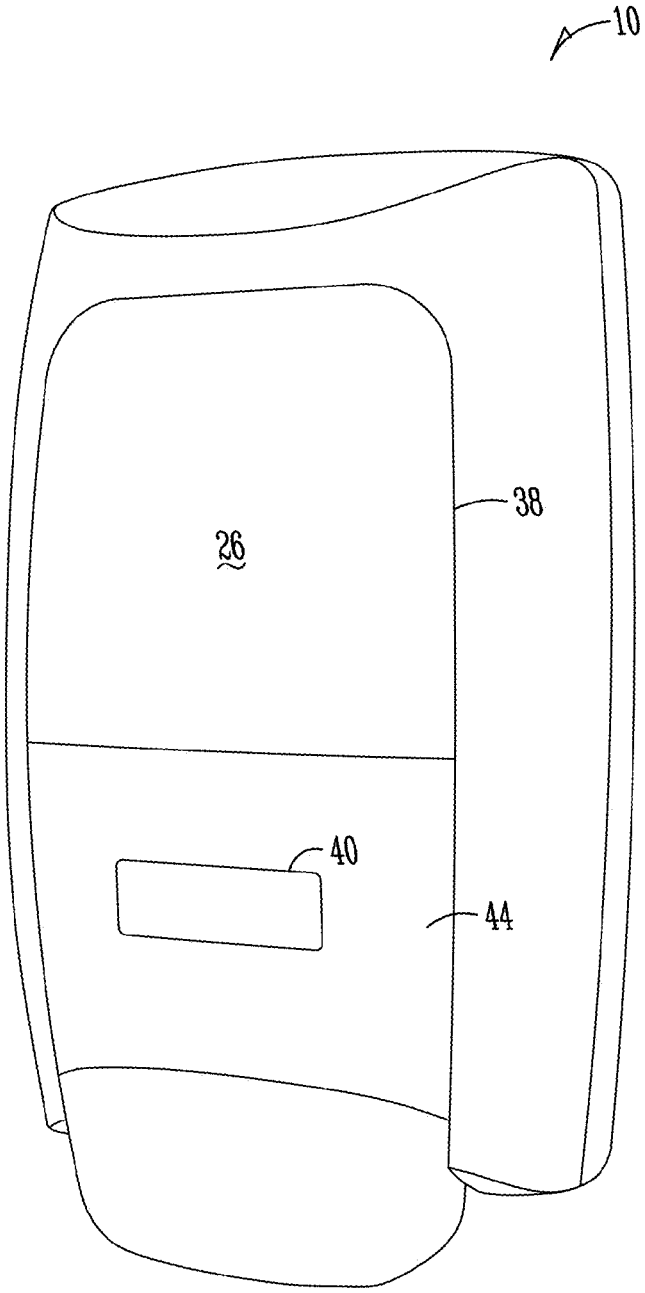
FIG. 6 is a pictorial representation of exemplary product and equipment housing illustrating an exemplary embodiment of the invention.
Figure 14:
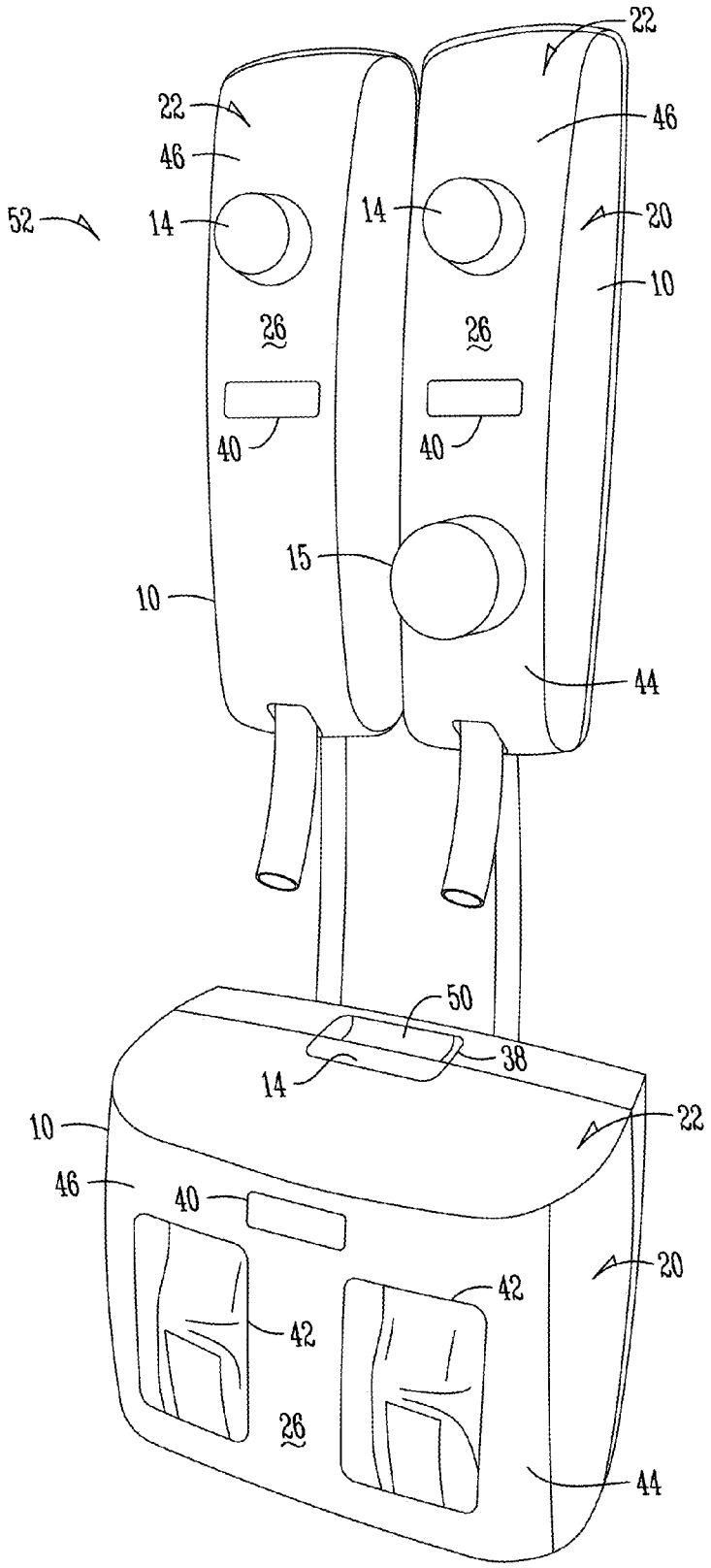
FIG. 14 is a pictorial representation other product dispensing housing illustrated according to another exemplary aspect of the present invention.

FIG. 6 is a pictorial representation of an exemplary housing 10 of the present invention. In addition to all of the aforementioned elements of housing 10, one or more shapes of housing 10 are configured, for example, as simple rectangular geometries with larger corner radii, otherwise known as a roundtangle. In one configuration of housing 10, the roundtangle 38 is intended as a neutral design element that compliments the flowing curvature and surfaces of the housing 10. Other elements of the housing 10 may also be configured as a roundtangle geometry. For example, internal elements (e.g., handles, push bars, badges, user interface overlays, windows, and the like) may be based off of and configured as a roundtangle geometry where possible, with the exception where such a roundtangle geometry might negate function or ease of use. Element 40 may be configured as a window or a badge housing, and shaped as a roundtangle geometry that is centered relative to the surface on which element 40 resides. Note for example that element 40 is centered relative to the surface on which it resides as opposed to being centered relative to a primary surface of the housing 10 or a horizontal center of the housing body 10. If, for example, aligning element 40 or roundtangle 38 with the center of the surface or the housing is not possible, the element 40 or roundtangle 38 may be centrally aligned with a secondary surface or mass of housing 10. Note for example in FIG. 8 that element 40 is centered relative to the center of housing 10 whereas element 42 is centered relative to secondary mass 44. Similarly, both elements 40 and 42 are shaped as a roundtangle geometries, likewise interaction point 14 is shaped as a roundtangle geometry and is centered relative to the global center of housing 10 as opposed to the center of secondary mass 44. FIG. 14 provides another example of alignment of a roundtangle feature of housing 10. Note, for example, that element 40 configured as a roundtangle geometry is centered relative to the primary surface 26 of housing 10 whereas interaction point 14 and interaction point 15 are centered vertically relative to secondary mass 44 and secondary mass 46 respectively. Thus, roundtangle features of housing 10 may be centrally aligned with a center of the housing 10 or a secondary mass of housing 10.

Figure 7:
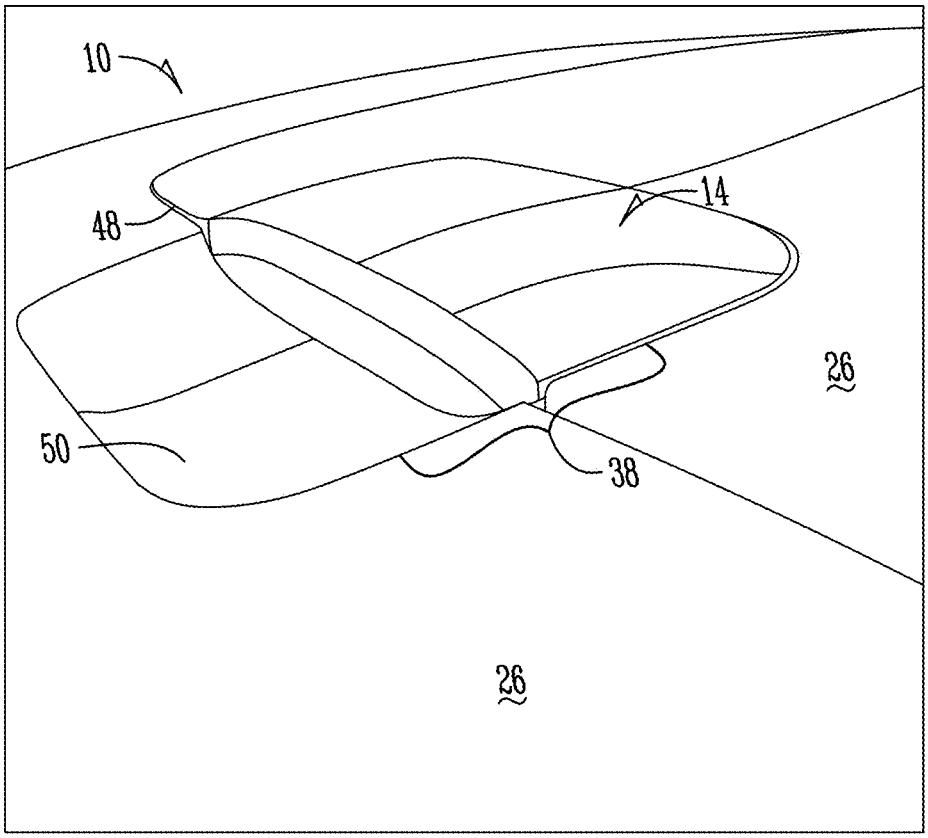
FIG. 7 is a pictorial representation of a touch point for product and dispensing equipment housing according to an exemplary aspect of the present invention.

FIG. 7 provides a pictorial representation of a section of housing 10 according to an exemplary aspect of the present invention. The housing 10 may be configured with one or more interaction points 14 or primary touch points. These interaction points 14 or primary touch points may be configured in or on one or more surfaces of the housing 10. Examples of an interaction point 14, may include, a handle, product selector, dial, button, slide, push bar, or any of the like. Since the interaction point 14 operates as a primary touch point for an operation or function of housing 10, it is preferred that the interaction point 14 is configured to identify a function or operation of one or more components of the housing 10 and elicit a desired response from a user interacting with the one or more interaction points 14 on housing 10. As best illustrated in FIG. 7, interaction point 14 is preferably configured as a clean, glossy blue color. The present invention contemplates that other clean, glossy colors may be used that draw or elicit attention of the user to each of the primary touch points or interaction points 14 on housing 10. The interaction point 14 may also be configured as a roundtangle geometry, such as where possible. The interaction point 14 represents primary tactile representations of branding for the housing 10, function, and/or operational purpose of the components within or on the housing 10. Though the interaction point 14 is described as having a roundtangle geometry, the present invention contemplates that other geometric shapes may be used for highlighting and drawing attention to the interaction point 14 relative to its position on housing 10, increasing visibility to the user or eliciting a desired user response. As previously indicated, the interaction point 14 may include a color element such as blue so as to create a color break, material change, and/or finish variation in one or more portions of a surface of housing 10. Beneficially, a chosen color for the interaction point 14, such as glossy blue, is easy to wipe clean and will generally not collect dirt as a textured finish might. Thus, a gloss, smooth colored surface is preferable, such as a glossy blue smooth surface. Another feature of the interaction point 14 is the transition of the surface surrounding the interaction point which may be pillowed so that the surrounding surface transitions gently to the surface level of the interaction point 14. By way of example, FIG. 7 illustrates surface of housing 10 surrounding interaction point 14 having a pillowed transition 48 between the surrounding surface and the interaction point 14. Further details may be provided at the interaction point 14 such as a scoop or recess in a surface adjacent or intimate to the interaction point 14 that allows or provides clearance for a user to insert his or her fingers to easily grip and manipulate the interaction point 14. For example, if the interaction point 14 is a handle or other primary touch point, the user is able to insert his or her fingers in the recessed portion 50 of the interaction point 14 to easily grip or secure his or her fingers around the interaction point 14 to perform an operation elicited by the interaction point 14. According to another exemplary element of the interaction point 14, the recessed portion 50 and interaction point 14 together form a complete roundtangle 38 geometry providing a uniform and consistent appearance relative to the other portions of the housing 10 as previously discussed.

Figure 8:
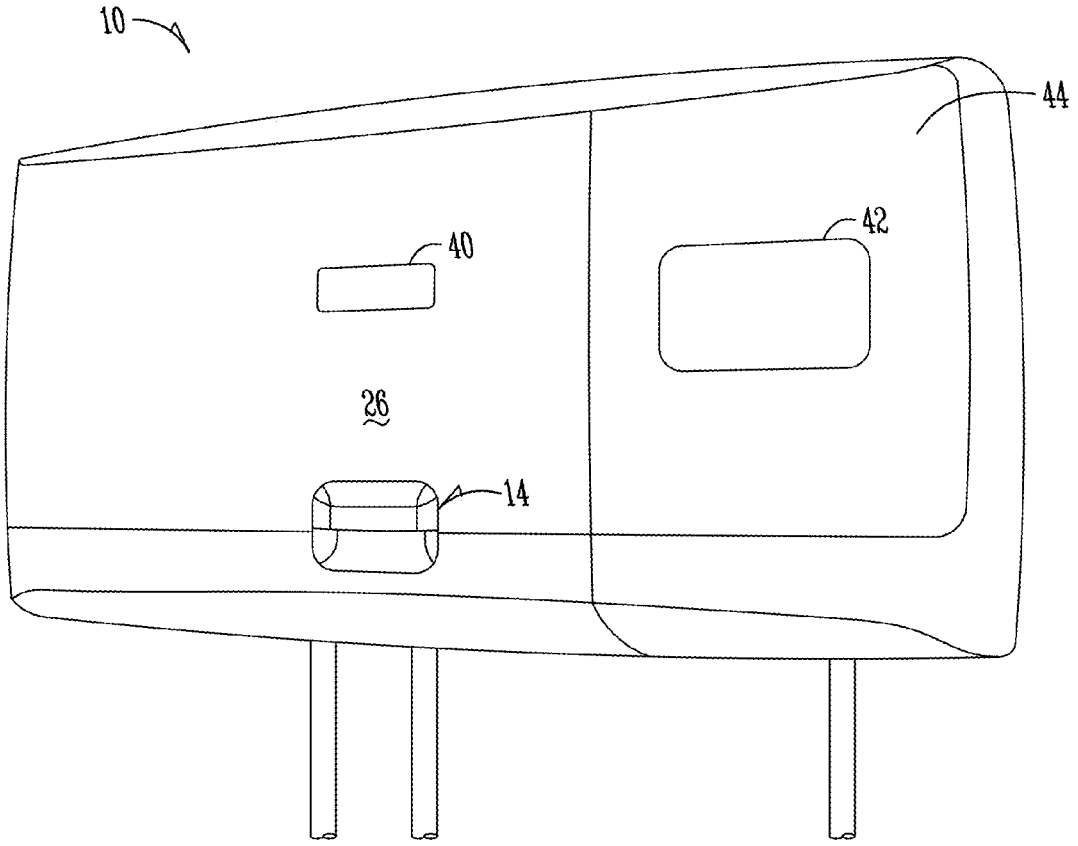
FIG. 8 is a pictorial representation of dispensing equipment housing illustrated according to one aspect of the present invention.

FIG. 8 provides another pictorial representation of a housing type 10 configured to enclose, at least partially, one or more operational components for providing a dispensing function. The housing 10 like others includes a primary surface within which element 40 is centered and a secondary mass 44 within which element 42 is centered. Additionally, an interaction point 14 is centered on the primary surface 26. The interaction point 14 and elements 40 and 42 are configured as roundtangle geometries, as previously discussed, to provide a consistent and uniform appearance to housing 10. According to one exemplary configuration of housing 10, element 40 may include a product or company branding badge, logo or advertisement. Preferably, but not necessarily, such a badge or brand element may be positioned so as to be aligned with the center of the primary surface 26. Brand badges, plates or the like may be printed directly onto the surface of housing 10, such as the primary surface 26 as illustrated in FIG. 8 or constructed of a material that accents the branding badge or logo such as a brushed stainless steel metal badge. The size, shape, angles, curvature, and relative proportions of the branding badge, logo or advertisement may be configured to accord with element 40 desired size and position relative to the primary surface 26 on housing 10. Similarly, other elements such as element 42 may be included on housing 10. Element 42, as previously indicated, is centered relative to secondary mass 44 as opposed to being centered relative to the primary surface 26. Element 42 is generally configured as a roundtangle geometry. Element 42 may comprise a user interface, display or window that apprises the operator or user of information relating to the operational components housed within the housing 10 or elicits a preferred or desired response from an operator or user by presenting information through or at element 42. For example, an intelligent control may be configured in operable control of one or more dispensing control apparatuses. These devices may be configured to receive instruction from and provide information to, through or at element 42 via, for example, a graphical user interface. Element 42 may also be configured as a window to allow the user to monitor and view operation of one or more components within the housing, the status of one or more components in the housing, the level of one or more supply sources within the housing, or the like. One or more conduits may be connected in communication with the components within the housing to provide, for example, dispensing to a related process.

In addition to the shape, proportion, curvature, outline, and layout of the various features of housing 10, the present invention contemplates that each of these features may be given a specific color or have a specific color pattern to accent, draw attention to or elicit a desired response or interaction from the user. For example, both color and finish selections may be made to each of the aforementioned features of housing 10 so that collectively they mesh together well to present a uniform brand, appearance and configuration for housing 10; taken together these features are to provide an enclosure for housing, at least partially, an apparatus, one or more components, features for dispensing, solutions, controllers, pumps, valves, electrical boards, or the like. Maintaining uniform appearance also requires that the environment in which the housing 10 is positioned be evaluated. For example, in the case where housing 10 is a dispensing housing for a dispenser the present invention contemplates making choices as to the finish and color of the features of the housing that complement the environment in which the dispenser and its accompanying housing 10 is to be installed. As previously indicated, features of the housing 10 may be colored having such colors as white, grey, black, blue or the like. The finish may be smooth, semi-smooth or semi-textured depending on the type of appearance that is desired. For example, as previously discussed, interaction points 14 are preferably a high gloss finish and configured with a blue color to offset the interaction point from a surrounding surface colored in white, mid-tone gray, dark gray or like solid color that successfully reduces the visual appearance of dirt, grease, fingerprints (e.g., white space around an interaction point 14). Other areas, such as high traffic areas 18 (see FIG. 1) may be configured in a grey color to hide any dirt or grime that may collect on the surface. The surface finish is also preferably a gloss to high gloss finish to prevent or minimize the accumulation of dirt and grime and degradation of the surface over time.

Figure 9A:
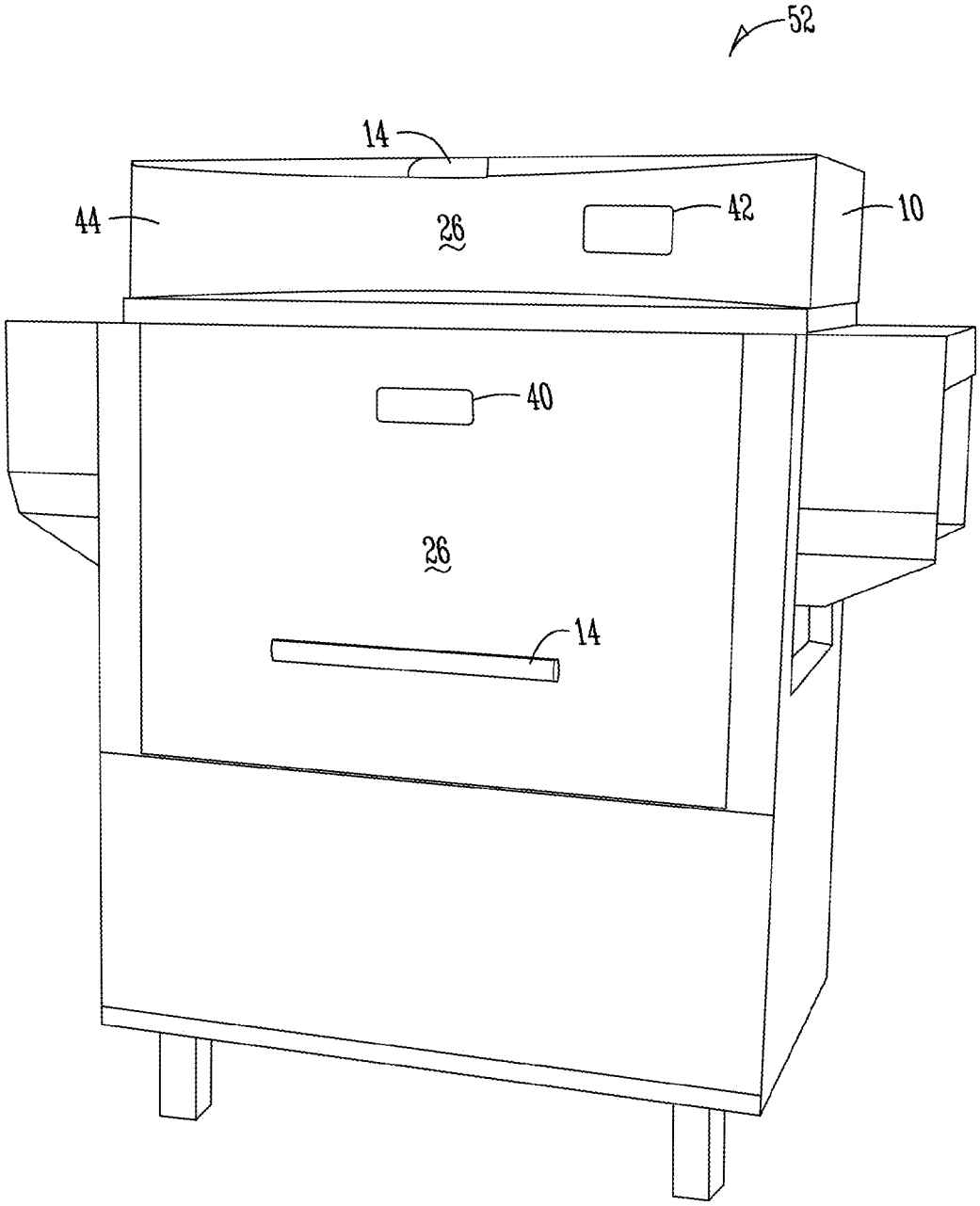
FIGS. 9A-9B are pictorial representations of exemplary equipment housing configured according to one aspect of the present invention.
Figure 9B:
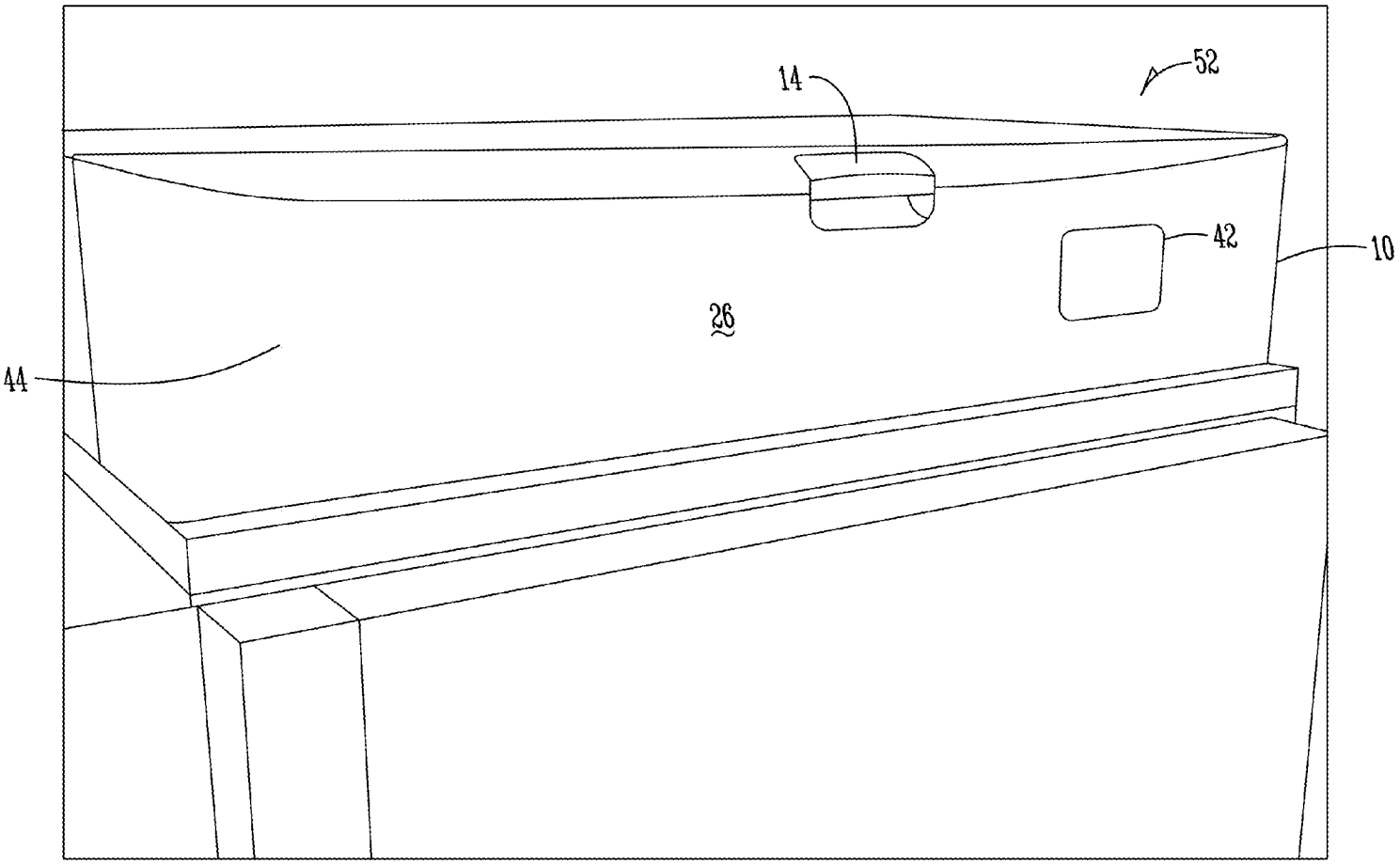

FIGS. 9A and 9B provides a pictorial representation of an exemplary housing 10 configured according to one aspect of the present invention. The product 52 illustrated in FIG. 9A may be configured with a housing 10, as best illustrated in FIG. 9B, that fully or at least partially encloses one or more operational components within the housing. The product 52 illustrated in FIG. 9A may be configured as a dispenser or equipment that houses one or more operational components configured to operate in communication or correspondence with an intelligent control and one or more pumps connected in communication with a fluid source such as product source for providing a functionality relating to a process of the product 52. The product 52 may also include a housing 10 configured to allow the insertion and removal of product and/or wares into the housing 10 wherein an operation or function is performed using operational components within the housing. In one aspect of the invention, the product 52 may be configured as a dish machine with integrated dispensing supported by one or more operational components housed or enclosed, at least partially, within housing 10. The housing 10 is configured to provide a uniform and consistent appearance across the various surfaces that form the outer portion or viewable (e.g., visible) portions of the housing. The housing 10 may be configured with one or more interaction points 14 or elements 40 and 42. Illustrating the examples discussed above, best shown in FIG. 9B, the housing 10 includes a primary surface 26. An interaction point 14 (e.g., a handle) is centered on the primary surface 26. Surface transition(s) are provided between the primary surface 26 and the interaction point 14 as previously described. Additionally, an element 42 having a roundtangle geometry is configured on a secondary mass 44. The element 42 is centered relative to the secondary mass 44 to provide a uniform and consistent appearance. The element 42 may include a graphical user interface, a window or a display for providing or receiving information or otherwise allowing the user to interact with the product 52 via the housing 10. The element 42, as previously discussed, may also provide a window to view an operation, function or process of the operational components within the housing 10. Element 42 may also provide a viewing window to view product, liquid sources or other operational components within the housing. A similar element 40, as illustrated in FIG. 9, may be included on another primary or secondary surface of the housing 10. Element 40 may include, as previously discussed, a badge, logo or brand for alerting or apprising the user as to the source of the product 52, the function or operation of the product 52 or elicit a specific response from the user or operator.

Figure 10:
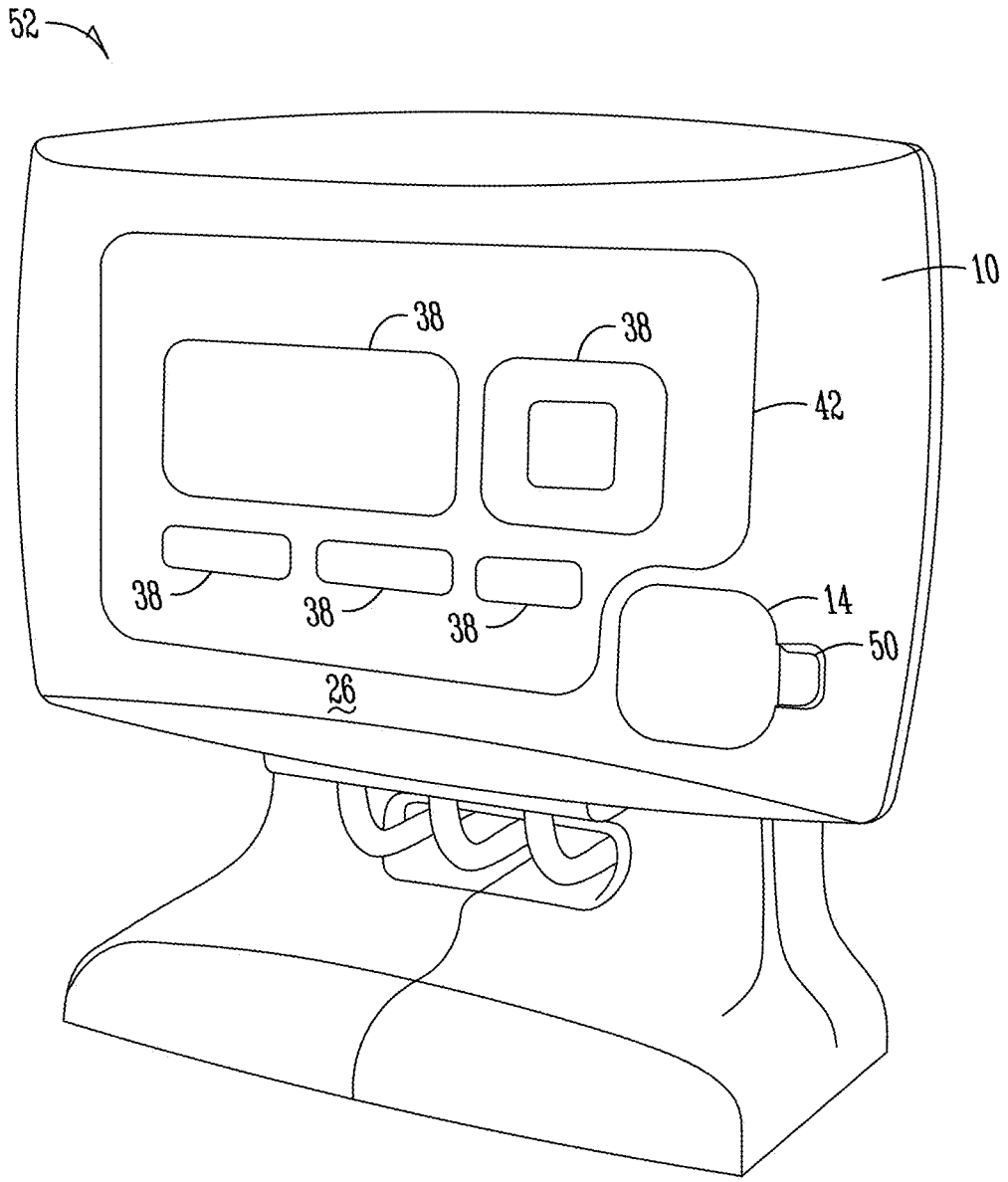
FIG. 10 is a pictorial representation another type of equipment housing illustrated according to another aspect of the present invention.

FIG. 10 provides a pictorial representation of another exemplary housing 10 configuration of the present invention. For example, product 52 may be configured as a housing for a controller for controlling one or more operations of a related process. The housing 10 of product 52 is configured with the elements as previously set forth. For example, the housing includes a primary surface 26 on which an element 42 is centered. The element 42 has generally a roundtangle geometry. Element 42 is one example where the roundtangle geometry shape has been altered to accommodate the positioning of an interaction point 14 on the primary surface 26. Additionally, the element 42 may include, for example a graphical user interface, window or other interaction point whereby the user interacts with the product 52 or receives instruction or provides instruction to an operational controller housed within housing 10. Within the element 42 other element components may be presented having a roundtangle 38 geometry as shown. These additional roundtangles 38 may comprise features of the graphical user interface (e.g., soft or hard keys) or viewing windows providing information or feedback to the user based on an operation or process of the product 52. As indicated, element 42 may include one or more buttons, such as soft or hard buttons that allow the user to interact with the product 52. These features are preferably, but not necessarily, shaped to have the roundtangle 38 geometry. The roundtangle geometry provides uniform shape and appearance for the various elements presented on the primary surface 26 of housing 10. Additionally, an interaction point 14 may be included on the primary surface 26 of the housing 10 whereby the user may gain access to the housing 10 through a door, gate, cover, or other opening to the housing. The interaction point 14 is also a roundtangle geometry thereby maintaining the uniform appearance of the housing 10 while still being congruent with the other geometries presented on the primary surface 26 of housing 10. Within the housing 10 may be included, for example, an intelligent control and one or more operational components such as a memory storage component, one or more actuators, a control board, a graphical display, and other like components for providing operational processes or functions relating to the product 52. The housing 10 may be shaped or configured to provide uniformity and consistency in shape and appearance yet fit around all of the aforementioned components within or associated with the product 52.

Figure 11:
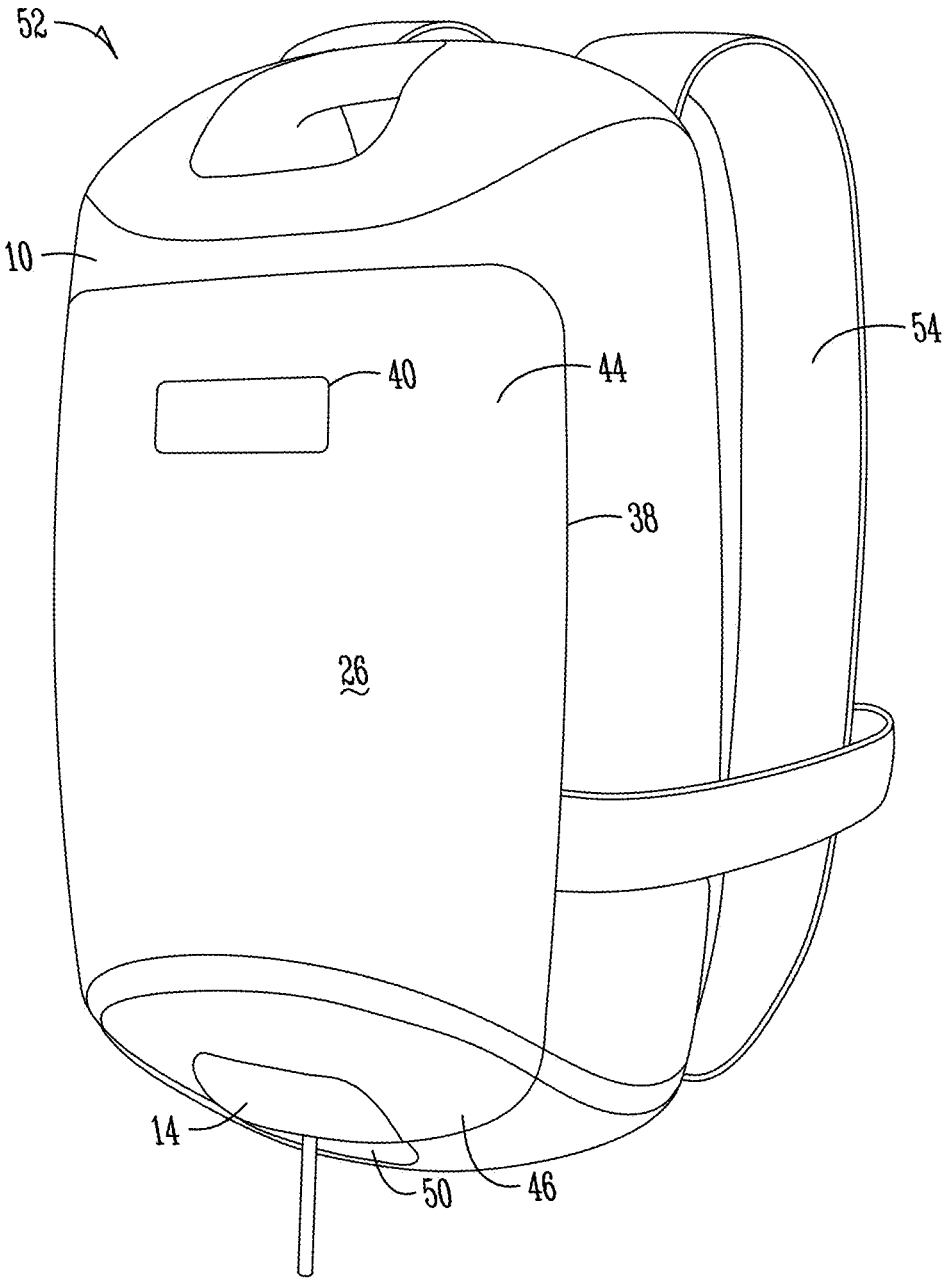
FIG. 11 is a pictorial representation of an exemplary configuration for a product housing illustrated according to one aspect of the invention.

FIG. 11 provides a pictorial representation of another product 52 configured with a housing 10 illustrating exemplary elements of the present invention. The product 52 may be configured to house one or more liquid components along with one or more functional components for dispensing the liquid component from the housing 10. Other operational components such as an intelligent control, one or more actuators, a pump or other like mechanisms may be included within housing 10 to provide operation of the various functions of the product. Product 52 includes a housing 10 that has many of the elements that have been disclosed relating to the various features and elements of the product 52 in housing 10 of the present invention. Housing 52 may be shaped and sized to allow the housing 10 to generally enclose, at least partially and preferably completely, the operational components, dispensing components, or other like components housed within the housing 10. The housing 10 includes a primary surface 26 with an element 40 centered vertically on the primary surface 26. The element 40 may include, for example, a badge, logo or other indicia representing or providing indication of the source of product 52. Element 40 may also provide a window into the housing 10 to view operation or status of one or more of the components within housing 10. Element 40 may also include a display or interface for providing information to and receiving information from a user. For example, hard or soft keys may be included at element 40 whereby a user enters information or is shown information related to an operation of one or more of the processes or components within housing 10. As shown, element 40 is centered horizontally relative to a secondary mass 44 of the primary surface 26 and not relative to the primary surface 26 as a whole. This is illustrated in other various product and exemplary housing configurations as previously shown and described. The housing 10 may include a roundtangle 38 circumscribing, for example, a door or cover providing access to within housing. An interaction point 14 (e.g., a handle) may also be included on housing whereby operation of the interaction point 14 allows access into housing 10 through the door or cover defined by the roundtangle 38. The interaction point 14 preferably, but not necessarily, is configured as a roundtangle geometry to provide a consistent and uniform appearance with the rest of the housing 10. The interaction point 14 is centered vertically relative to the primary surface 26 and horizontally relative to a secondary mass 46 of the housing 10. Thus, the position of the interaction point 14 and element 40 provide a uniform and consistent appearance even though these features are not centered horizontally relative to the primary surface but relative to respective secondary masses 44 and 46. The housing 10 may also include one or more straps 54 to allow the product 52 to be portable or carried by a user.

Figure 12:
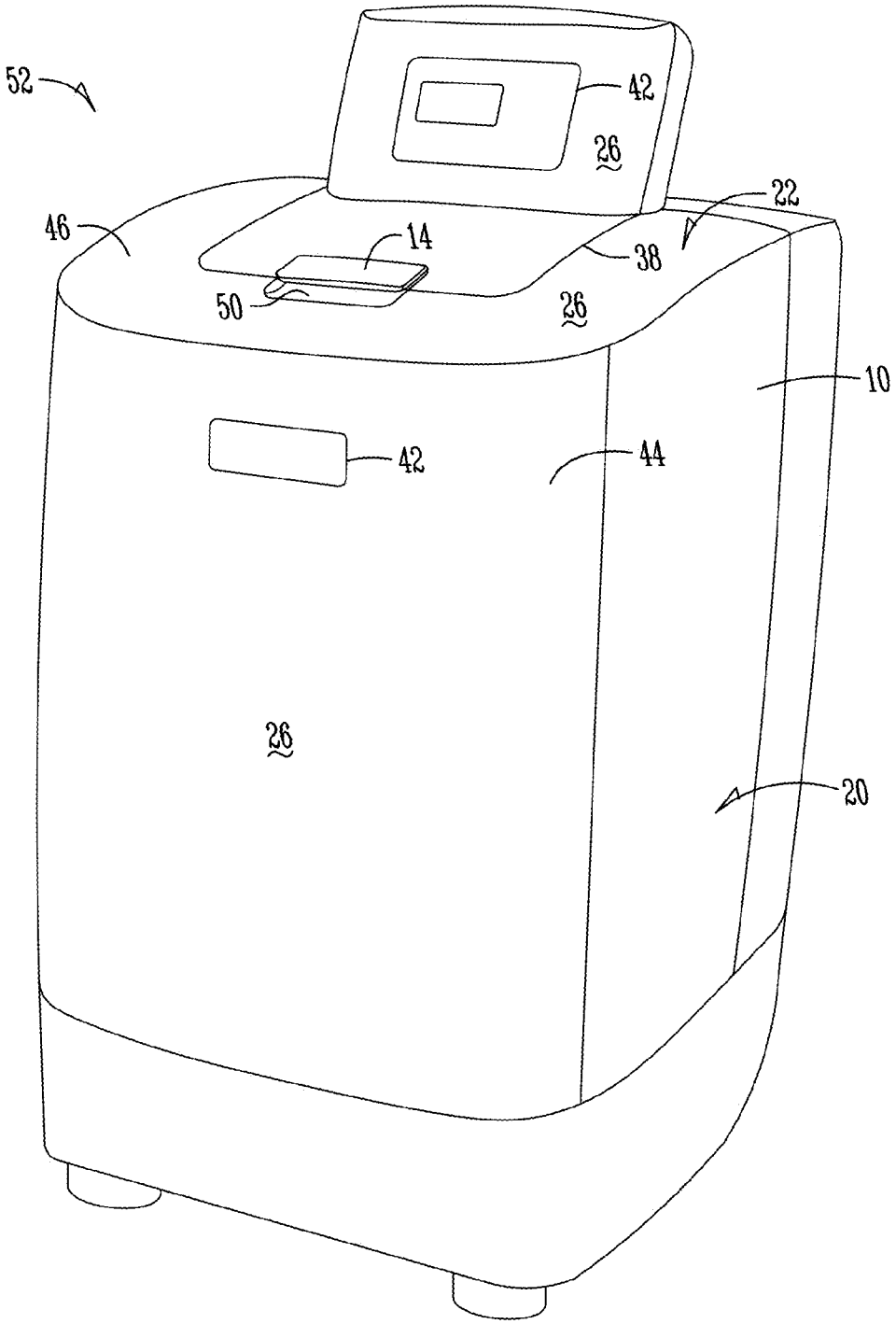
FIG. 12 is a pictorial representation of another equipment housing configuration illustrated according to an exemplary aspect of the present invention.

FIG. 12 provides a pictorial representation of a product 52 having a housing 10 with elements according to one or more of the exemplary aspects of the present invention and as previously described. Product 52 includes a housing 10 providing a cover that encloses one or more operational or functional processes or components for providing a function or operation of the product 52. The size, shape, proportion, curvature, and external dimensions of the housing may be altered to accommodate any one of the operational, functional or processes occurring within the housing. Furthermore, for example the housing 10 may include a base supported by one or more legs having a primary surface 26 forming a primary section of the body of the housing. The primary surface 26 may include an element 42 centered vertically relative to the primary surface 26 and centered horizontally relative to the secondary mass 44 of the housing. The element 42 may include a badge, logo, or other indicia indicating the source of product 52, operation performed by product 52 or the like. As indicated above, element 42 may function to provide a window into the housing 10 to view one or more of the processes or function of operational components within the housing 10. Element 42 may also function as a display for providing indicia to the user, soft or hard keys for receiving instructions from the user or providing a way for the user to input information into the product 52. The primary surface 26 having the element 42 is contained in a curvature form 20 as previously set forth and described in earlier descriptions and embodiments of the present invention. Connected to curvature form 20 is another opposing curvature form 22. A primary surface 26 of the curvature form 22 includes a roundtangle 38 providing a consistent and uniform appearance with the other features and components of housing 10. An interaction point 14 (e.g., a handle) is provided adjacent a portion of the roundtangle 38. The interaction point includes a recessed portion 50 for allowing the user to access the interaction point 14. The interaction point 14 and recessed portion 50 together form a roundtangle geometry centered generally relative to a secondary mass 46 of the primary surface 26. The interaction point 14 may be configured to allow a user to gain access to within the housing 10. The interaction point 14 may also be configured to lift a cover or door circumscribed by the roundtangle geometry 38 in order to insert or remove product or other components from within the housing 10. The housing 10 may also be configured with an element 42 centered generally on another primary surface 26 or a secondary surface. The element 42 may include a graphical user interface or display for providing information to or eliciting information from a user. The element 42 may also provide a window into the housing for viewing or monitoring a process or operation of the product 52. Element 42 may include buttons such as soft or hard keys, allowing the user to interact with element 42 or receive information from element 42. One or more operational components may be configured within housing 10 for providing indicia at element 42 for viewing by the operator or receiving information from the user. For example, an intelligent control may be configured in operable communication with the graphical user interface housed within the element 42 whereby control of one or more operational procedures is performed via the graphical user interface in operable control of an intelligent controller. One or more functions are operations of the product 52 may be controlled by a process of entering information through element 42 via a graphical user interface in operable communication with an intelligent control for controlling one or more operational components or operational processes of the product 52.

Figure 13:
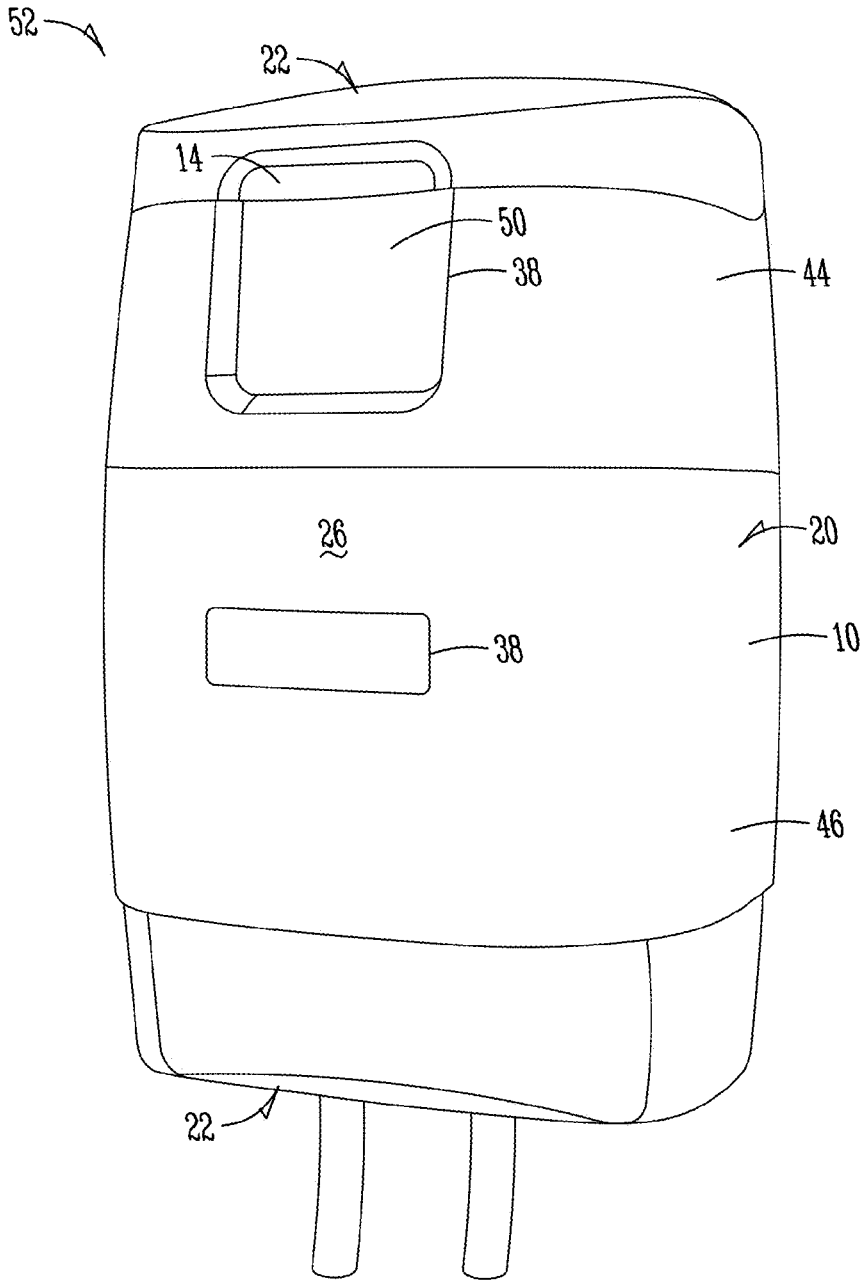
FIG. 13 is a pictorial representation of product dispensing housing illustrated according to an exemplary aspect of the present invention.

FIG. 13 provides a pictorial representation of another product 52 configured with exemplary aspects of the housing 10 of the present invention. Product 52 may be configured to house one or more dispensing products, dispensing equipment or operational components, or dispensing functions. The housing 10 may be configured in shape, size, proportion, and configuration to accommodate the one or more operating components of product 52. Similar to other products illustrated and described in the previous figures, product 52 illustrated in FIG. 13 includes a housing 10 having a curvature form 20 and an opposing curvature form 22 having element 42 centered relative to a secondary mass 46 of curvature form 20. The element may include a badge, logo or other indicia indicating a source of product 52, a functional or operational or intended purpose of product 52. The housing 10 also includes a primary surface 26 spaced between curvature form 22 extending from left to right across the front face of housing 10. An interaction point 14 is also included on curvature form 20. The interaction point 14 may be configured as, for example, a handle accessible with ones fingers via a recessed portion 50. Together the interaction point 14 and recessed portion 50 form a roundtangle 38 geometry for providing uniform and consistent appearance of the elements of the housing 10. Operation of the interaction point 14 allows access to within housing 10 via a cover or lid located at the top portion of housing 10. The lid or cover may break from the curvature form 20 along a line separating the curvature form 20 from curvature form 22. Together the interaction point 14 and recessed point 50 form, as previously indicated, a roundtangle geometry 38 that is centered on the primary surface relative to secondary mass 44. The secondary mass 44 may also be configured as a window or inspection point for the user to observe or view the operational components, product or other functions housed within the housing 10. For example, through the secondary mass 44 the user may be able to view, for example, the level of product contained within the housing 10. This may be accomplished by forming the surface of the secondary mass 44 out of a translucent material providing the user with the opportunity to view the internal components, operation and function of the product 52. The operational components housed within the housing 10 may be connected in communication with one or more hoses extending into an out of the housing 10. One or more of the operational processes, functions or components may be supported by communications of product or other liquid supporting media through conduit into and out of the housing 10.

FIG. 14 provides a pictorial representation of a product 52 illustrated with housing configured according to exemplary aspects of the present invention. Product 52 may be configured as a product dispenser wherein liquid or dissolved solid product is dispensed at a specific desired ratio. The housing 10 may be configured to house one or more operational components for providing such operation of product 52. For example, housing 10 may include one or more controllers under operation of an intelligent control providing control of a pump or other like apparatus. Consistent with the other elements illustrated and discussed above, housing 10 includes a curvature form 20 and opposing curvature form 22. The components illustrated in the top portion of FIG. 14 both have these afore-described features. In addition, the housing 10 includes a primary surface 26 on which an element 40 is centered. The element 40 may be a badge, brand or provide other indicia as previously described. An interaction point 14 may be included on the primary surface 26 and centered relative to secondary mass 46 whereas another interaction point 15 may be included on the primary surface 26 and centered relative to secondary mass 44. The interaction point may be configured as handles or other operator input mechanisms. Interaction points 14 and 15 may also be configured as dials whereby a user provides a selectable parameter for the one or more operational components or processes of the product 52. A hose or tubing may be configured to communicate with one or more of the operational components or processes within the housing 10. Depending upon the type of dispensing process desired, the user may operate the left positioned housing 10 or the right positioned housing 10. The left positioned housing includes an interaction point 14 centered on the primary surface relative to the secondary mass 46. Connected in operable communication with these housings is another housing 11 of product 52. The housing 11 illustrated on the bottom of FIG. 14 includes a curvature form 20 and opposing curvature form 22. Hidden on primary surface 26 of housing 11 is an element 40 which may include, present or receive information as previously described. A pair of elements 42 may also be positioned on primary surface 26; element 42 on the left is centered relative to secondary mass 46 while element 42 on the right is positioned and centered relative to secondary mass 44—the primary surface 26 being divided generally equally by secondary mass 44 and secondary mass 46. Elements 42 may be configured as windows into the housing 10 whereby the user may monitor or view, for example, dispensing product housed within the housing. Through element 42 the user may view the status of a liquid product housed within the housing 10. Alternatively, element 42 may be configured as a graphical user interface providing information to the user as to the status of one or more components or operational functions or processes housed within the housing 10. A graphical user interface at element 42 may be configured in communication with an intelligent control and one or more electrical operational components such as memory storage, hardware or other software components. An interaction point 14 (e.g. a handle) is provided as a means by which a user is able to access the housing by inserting his or her fingers through a recessed portion 50. Together the recessed portion 50 and interaction point 14 form a roundtangle 38 geometry to maintain the uniformity and consistency of the housing shape, size, configuration and appearance. By operation of the interaction point 14 the user may remove the curvature form 20 from off of the housing 10 to gain access to within the housing, for example, to replace product, monitor operational components or troubleshoot operations or functions of the product 52.

The preferred embodiments of the present invention have been set forth in the drawings and in the specification and although specific terms are employed, these are used in the generically descriptive sense only and are not used for the purpose of limitation. Changes in the formed proportion of parts as well in the substitution of equivalents are contemplated as circumstances may suggest or are rendered expedient without departing from the spirit or scope of the invention as further defined in the following claims.

What is claimed is:

1. A primary outer housing component for equipment, comprising:

two or more opposing continuous curvature forms, said opposing continuous curvature forms formed such that one of the forms comprises a construction with a vertical component and two walls extending from the right and left sides of the vertical component and the opposite form comprises a construction with a vertical component with a top wall extending from the top of the vertical component and a bottom wall extending from a bottom of the vertical component to connect the forms in the continuous curvature;

wherein the form with the vertical component and wails extending from the sides comprises a c-shaped form;

a form outline generally defined by a series of arcs;

a forward facing primary surface having first and second compound curves;

a secondary surface having a compound curve;

the primary surface having at least one roundtangle feature; and one or more primary touch points on said primary surface;

said touch points selected from the group consisting of a handle, a product selector, a dial, a button, a slide, and a push bar.

2. The primary outer housing component of claim 1 wherein said pair of opposing curvature forms are oriented horizontally or vertically.

3. The primary outer housing component of claim 1 wherein said roundtangle feature is centrally aligned relative to said primary surface or a secondary mass of said primary surface.

4. The primary outer housing component of claim 1 wherein said round tangle is formed by one or a combination of two or more of a handle, a push bar, a badge, a nameplate, a user interface overlay, a window.

5. The primary outer housing component of claim 1 wherein said roundtangle feature comprises a touch point.

6. The primary outer housing component of claim 1 wherein said primary touch point is formed by one or a combination of two or more of a handle, a selector, a dial, a button, a window, a logo badge, a logo plaque, a printed logo.

7. The primary outer housing component of claim 1 wherein said primary touch point comprises a partial roundtangle.

8. The primary outer housing component of claim 1 wherein said primary touch point comprises a non-roundtangle.

9. The primary outer housing component of claim 1 wherein said primary touch point is blue.

10. The primary outer housing component of claim 1 wherein said primary touch point provides a contrast in color from said primary surface.

11. The primary outer housing component of claim 1 wherein said primary touch point provides a contrast in material type from said primary surface.

12. The primary outer housing component of claim 1 wherein said primary touch point provides a contrast in surface finish from said primary surface.

13. The primary outer housing component of claim 1 wherein said primary touch point is raised outward from said primary surface.

14. The primary outer housing component of claim 13 wherein said primary surface surrounding said raised primary touch point is pillowed to transition said primary surface to said touch point.

15. The primary outer housing component of claim 1 wherein said primary touch point is recessed relative to said primary surface.

16. The primary outer housing component of claim 1 wherein said primary touch point signals where a user interacts with said dispenser.

17. The primary outer housing component of claim 1 wherein said primary surface is white.

18. The primary outer housing component of claim 1 wherein said primary surface includes a secondary area comprising a second color to aid in to minimize the appearance of interaction with the secondary area.

19. The primary outer housing component of claim 18 wherein said secondary area is gray.

20. A product housing comprising:

a primary outer body adapted to at least partially enclose a product container, the primary outer body includes:

a. two or more opposing continuous curvature forms, said opposing continuous curvature forms formed such that one of the forms comprises a construction with a vertical component and two walls extending from the right and left sides of the vertical component and the opposite form comprises a construction with a vertical component with a top wall extending from the top of the vertical component and a bottom wall extending from a bottom of the vertical component to connect the forms in the continuous curvature, wherein the form with the vertical component and walls extending from the sides comprises a c-shape form;

b. a form outline generally defined by a series of arcs;

c. a forward facing primary surface having first and second compound curves;

d. a secondary surface having a compound curve;

e. at least one roundtangle feature; and f. one or more primary touch points, said touch points selected from the group consisting of a handle, a product selector, a dial, a button, a slide, and a push bar.

21. The product housing of claim 20 having a liquid dispensing mechanism in operable communication with said product container.

22. The product housing of claim 20 having one or more operational components and a actuator in communication with at least one of said operational components.

23. The primary housing of claim 22 further comprising a user interface in communication with said actuator.

24. The primary housing of claim 20 includes one or more means generally opposite the forward facing primary surface for moving or mounting the product housing.

25. The primary housing of claim 20 wherein at least a portion of the roundtangle feature comprises a window for viewing the product container.

* * * * *